United States Patent [19]

Herbers et al.

[11] 4,163,923

[45] Aug. 7, 1979

[54] VARIABLE DUTY CYCLE LAMP CIRCUIT

[76] Inventors: Dennis M. Herbers, 550 Elvin Ave., Hamilton, Ohio 45013; William H. Gibson, 142 E. 43rd St., Covington, Ky. 41015

[21] Appl. No.: 777,728

[22] Filed: Mar. 15, 1977

[51] Int. Cl.[2] ..... H05B 37/02; H05B 39/04

[52] U.S. Cl. ..... 315/208; 315/199; 315/291; 307/252 B; 307/308

[58] Field of Search ..... 315/208, 194, 199, 291-293, 315/DIG. 4; 307/252 B, 252 N, 252 T, 252 H, 308

[56] References Cited

U.S. PATENT DOCUMENTS

| | | | |
|---|---|---|---|
| 3,147,928 | 9/1964 | Carpenter | 315/194 X |
| 3,171,066 | 2/1965 | Atkins et al. | 315/208 X |
| 3,793,557 | 2/1974 | Cramer | 315/199 |
| 4,087,702 | 5/1978 | Kirby et al. | 315/194 X |

*Primary Examiner*—Alfred E. Smith
*Assistant Examiner*—Charles F. Roberts
*Attorney, Agent, or Firm*—Diller, Ramik & Wight

[57] ABSTRACT

The effect of a three way lamp bulb is achieved with a single filament bulb through the use of a variable duty cycle circuit and a touch control mounted in the base of the lamp. The circuit features a touch control incremented counter which controls the ramp rise rate of a sawtooth generator which is synchronized with the A. C. source. A trigger circuit accepts the sawtooth waveform to produce triac control pulses of time durations dependent upon the ramp rise rate.

9 Claims, 7 Drawing Figures

VARIABLE DUTY CYCLE LAMP CIRCUIT

BACKGROUND OF THE INVENTION

This invention relates to circuits for controlling the duty cycle applied to a load from an a.c. source. A number of such circuits have been developed but it is of principal concern in connection with the present invention to provide such a circuit which is of relatively low cost and at the same is fully effective for the intended purposes.

It is further concern in connection with this invention to provide a lamp assembly involving a variable duty cycle circuit and a single filament bulb controlled thereby wherein the effect of a conventional 3-way bulb can be achieved with a low cost single filament bulb.

BRIEF SUMMARY OF THE INVENTION

Basically, the present invention involves a switch for controlling the connection of a load to an a.c. source and a trigger circuit which activates said switch for only part of the duty cycle. A variable ramp slope saw tooth generator is synchronized with the a.c. source through a synchronizing circuit and the ramp slope is selectively controlled, the generator driving the aforesaid trigger whereby the control output pulses generated by the trigger circuit are of variable time durations and are synchronized with zero crossings of the a.c. source to actuate the load-controlling switch.

More particularly, the circuit according to the present invention involves a variable ramp slope saw tooth generator in which a capacitor is charged at the varying rates though several resistors or combinations of them, the synchronizing circuit being effective to control a dumping switch which periodically dumps the capacitor at or near the zero crossings of the a.c. source to provide the variable ramp slope saw tooth waveform.

More specifically, the circuit according to the present invention utilizes a counter circuit having at least two output states which control the charging rate of the capacitor thereby to vary the ramp slope of the saw tooth waveform as required. The counter is incremented manually.

This invention also contemplates an improved lamp assembly utilizing a control circuit as described above wherein the control circuit controls the duty cycle of a single filament bulb and simulates the operation of a conventional 3-way lamp assembly. The manual increment circuit is a touch-responsive circuit which preferably is embedded in or associated with the base of the lamp whereby the whole forms a unitary and integrated assembly.

BRIEF DESCRIPTION OF THE DRAWING FIGURES

DETAILED DESCRIPTION OF THE INVENTION

Figure 6:
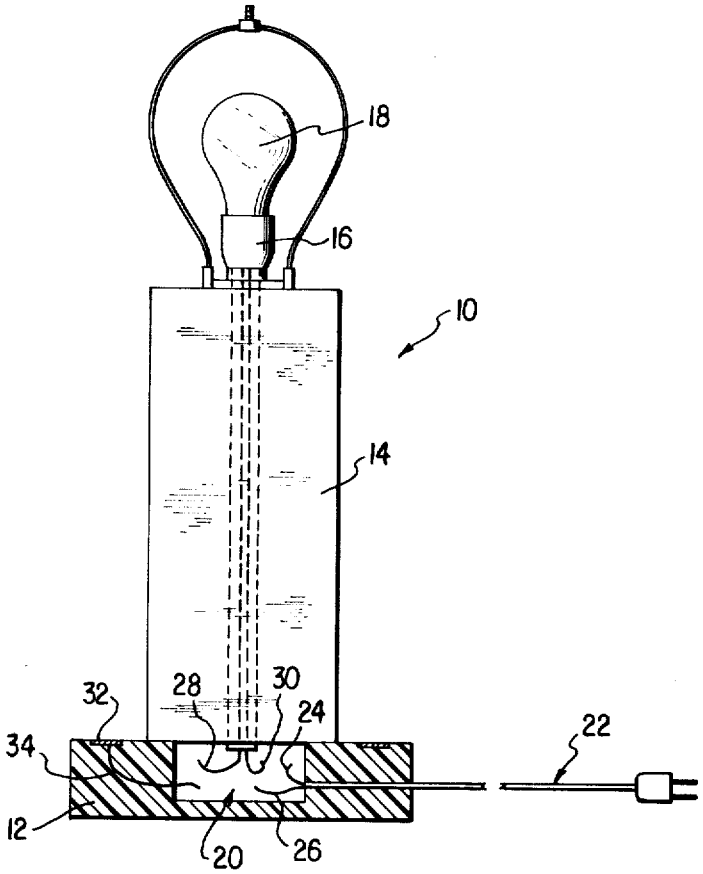
FIG. 6 is an elevational view, partly in section, illustrating an operative embodiment of the invention associated in a lamp assembly.
Figure 7:
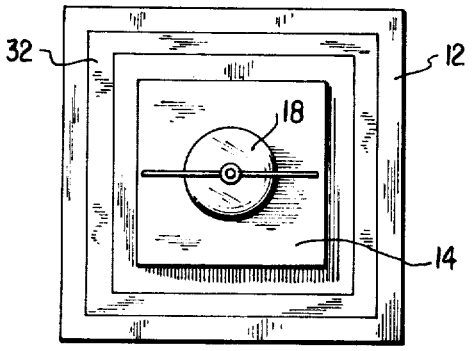
FIG. 7 is a plan view of the lamp assembly shown in FIG. 6.

Referring at this time more particularly to FIG. 6, a lamp indicated generally by the reference character 10 is illustrated therein and will be seen to include a base 12 and a stand 14 surmounted by a conventional light socket 16 containing a conventional single filament bulb 18. A circuit according to the present invention may be potted and inserted in the base of the lamp as indicated by the reference character 20, the power cord 22 having its leads 24 and 26 connected to the circuit 20 and the lamp socket 16 leads 28 and 30 also connected to the potted circuit 20. The base of the lamp as shown has also embedded therein a touch pad or conductor member 32 connected, as by leads 34, to the potted circuit 20. As will be more particularly described hereinafter, the operation of the lamp assembly 10 is such that when the touch bar or pad 32 is engaged by a person's finger or the like, a manual incrementing of the potted circuit 20 is effected whereby the duty cycle of the lamp 18 is increased. Specifically, a 4-way control is effected wherein in one state, the lamp is off, and in the next three states the lamp illuminates at increasing intensities, thereby simulating the effect of a normal 3-way bulb assembly.

Figure 1:
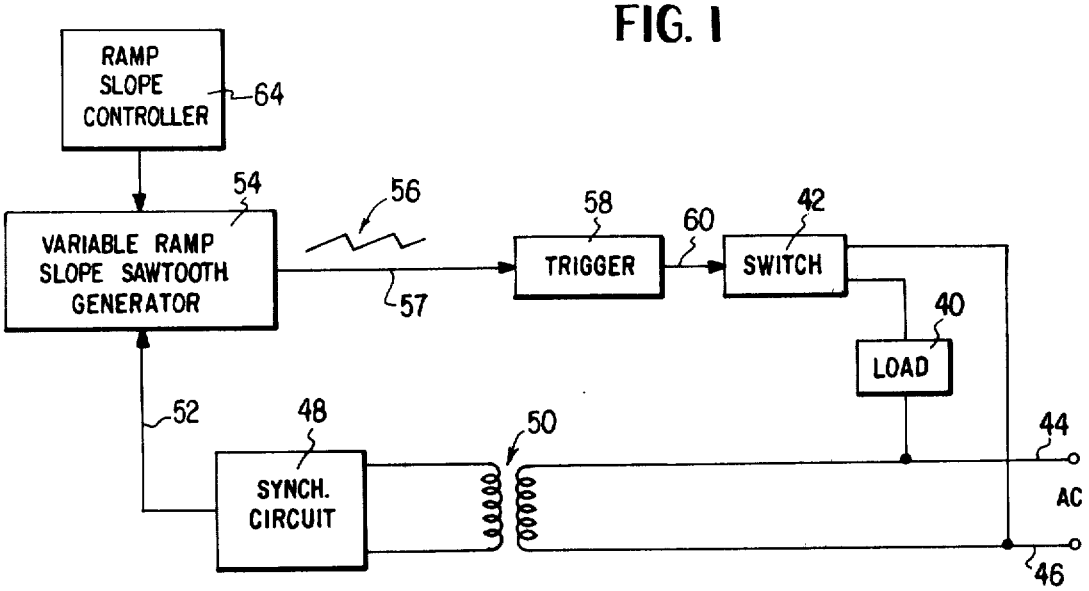
FIG. 1 is a block diagram illustrating certain principles of the present invention.

With reference to FIG. 1, certain principles of the present invention will be evident therefrom. As shown, a load 40 which may be the lamp 18 of FIG. 6, is connected through a controllable switch device 42 to the a.c. lines 44 and 46. A low voltage synchronizing circuit 48 is connected through the transformer 50 with the a.c. source and the synchronizing circuit 48 outputs at the line 52 control pulses which are synchronized with the zero crossings of the a.c. source. A variable ramp slope sawtooth generator 54 is controlled by the output pulses at 52 to produce a sawtooth waveform output as indicated at 56 which is applied to the trigger circuit 58. The trigger circuit outputs at the line 60 pulses of known time durations which actuate the switch 42 in synchronization with the zero crossings of the a.c. source for part of the duty cycle, thereby to connect the load 40 to the a.c. source for a portion of the duty cycle. The generator 54 is provided with a ramp slope controlling circuit 64 which controls the ramp slope or rise rate of the sawtooth waveform 56 thereby to control the time durations of the output pulses at 60 from the trigger circuit 58, correspondingly to vary the duty cycle experienced by the load 40.

Figure 2:
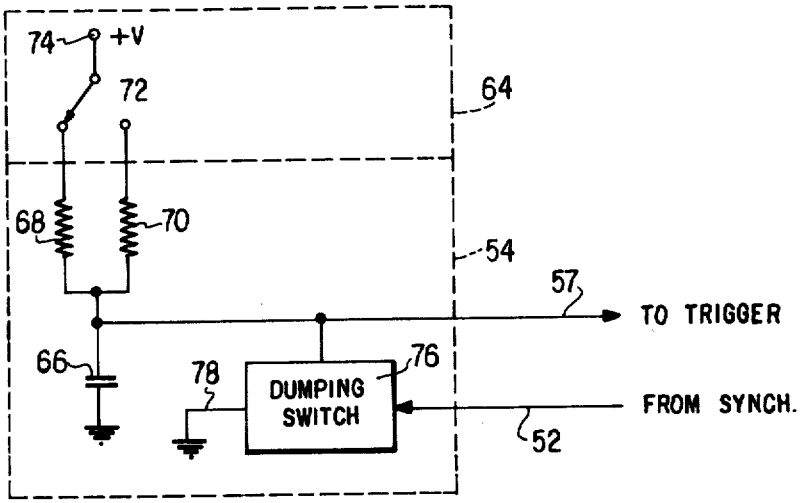
FIG. 2 is a circuit diagram partly in block form illustrating details of the variable ramp slope saw tooth generator.
Figure 3:
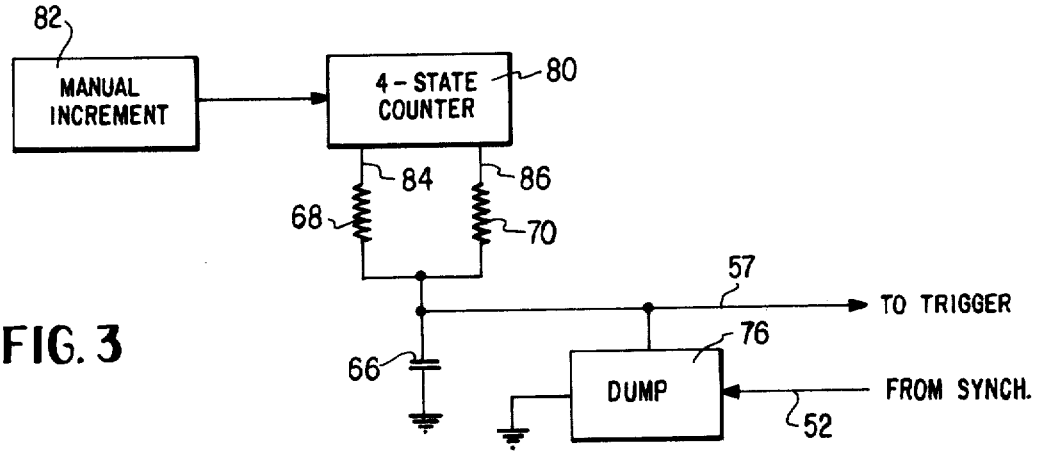
FIG. 3 is a block diagram expanding the diagram of FIG. 2 to show the use of a four-state counter for controlling the ramp slope.

As shown in FIG. 2, the generator 54 takes the form of a capacitor 66 and at least a pair of resistors 68 and 70 which are connected in parallel as shown. The ramp slope controller 64 takes the form of a switching device as indicated at 72 effective to connect either one of the resistors 68 or 70 to a source 74 of potential whereby, dependent upon the position of the switch device 72, the capacitor 66 will be charged either through the resistor 68 or through the resistor 70. The two resistors are of different values so that the charging rate of the capacitor 66 will vary dependent upon which of the resistors is connected. The pulses at the outputs 52 from the synchronizing circuit 48 control a dumping switch 76 which periodically, and in synchronization with zero crossings of the a.c. source, dumps the capacitor 66 to the ground lead 78 as shown, thereby producing the sawtooth output waveform 56 at the output 57 of the generator 54.

In a preferred embodiment of the invention, the ramp slope controller 64 takes the form of a 4-state counter 80 and a manual increment circuit 82 to increment the counter 80. In the embodiment shown, the counter 80 has two output leads 84 and 86 connected respectively to the resistors 68 and 70 for charging the capacitor 66. In one output state of the counter 80, neither of the leads 84 or 86 is energized and this represents the "off" state of the control circuit. In the next output state of the counter 80, the lead 84 is energized and the capacitor 66 is charged through the resistor 68, the resistor 68 being of higher value than the resistor 70 so that this represents the lowest charging rate for the capacitor 66. A third output state of the counter 80 energizes the lead 86 and thus charges the capacitor 66 at at somewhat higher rate through the resistor 70. In the fourth output state of the counter 80, both of the leads 84 and 86 are energized and the capacitor 66 is thus charged at the most rapid rate simultaneously through the two resistors 68 and 70.

Figure 4:
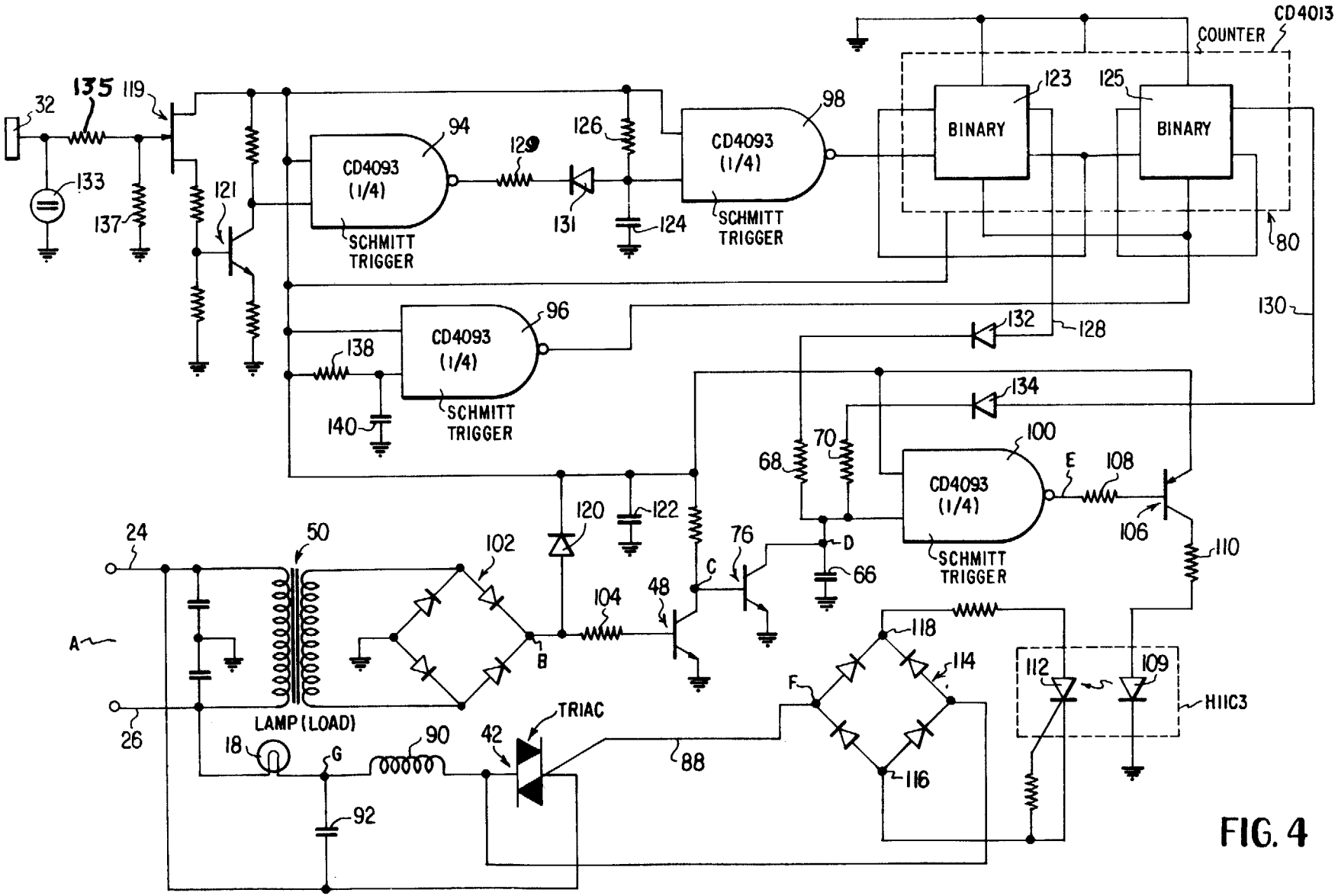
FIG. 4 is a circuit diagram of a preferred embodiment of the invention.
Figure 5:
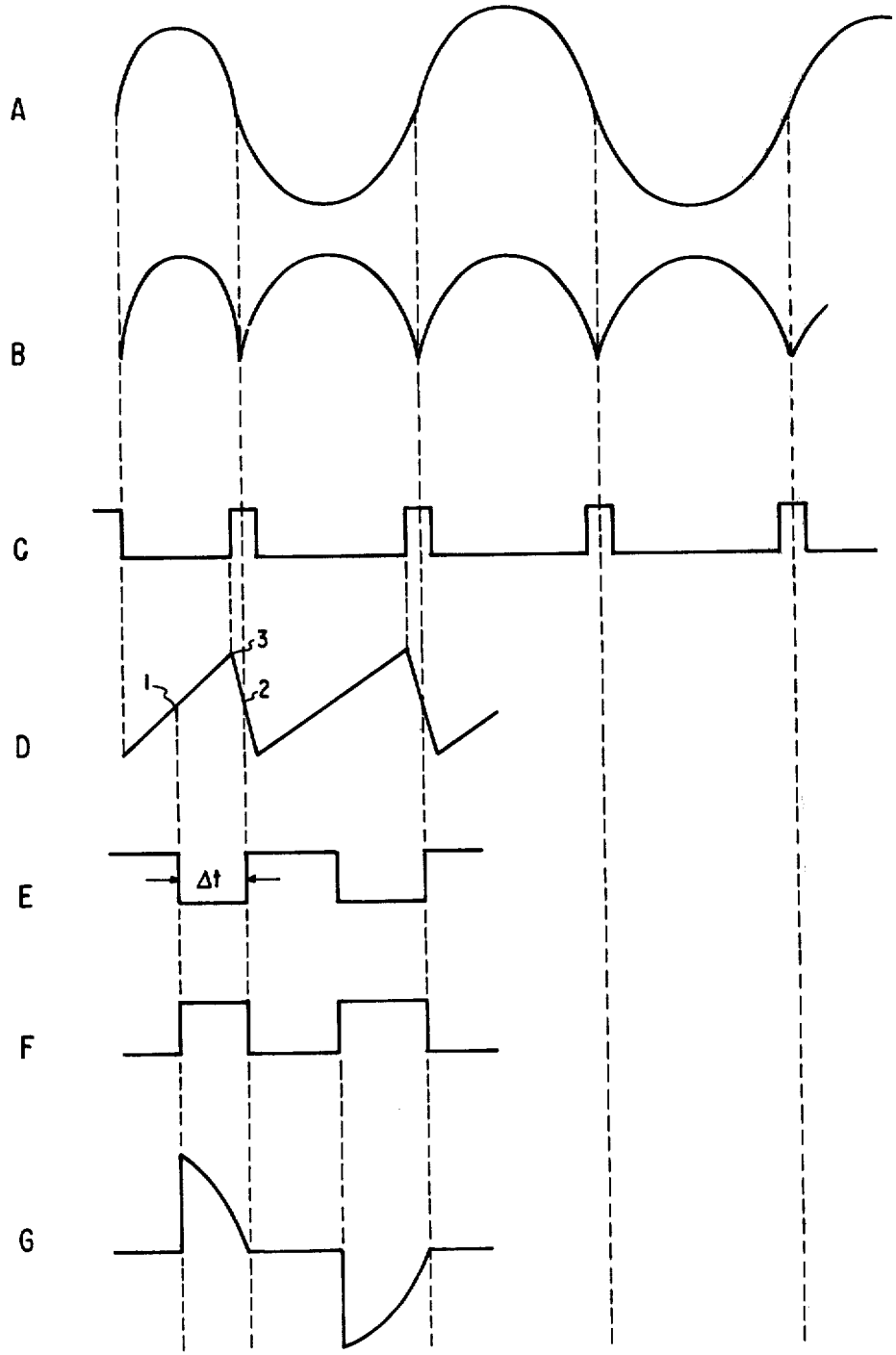
FIG. 5 illustrates waveforms at various points of the circuit of FIG. 4.

Referring at this time more particularly to FIG. 4 wherein an operative embodiment of the invention is shown, the lamp or load 18 will be seen to be connected to the a.c. input leads 24 and 26 through the TRIAC switch 42 whose operation is controlled by the electrode 88. The inductor 90 and capacitor 92 are provided for filtering purposes. The circuit includes four Schmidtt trigger circuits 94, 96, 98 and 100. The leads 24 and 26 are connected to one side of the transformer 50 and the output side is connected to diode bridge circuit 102 which produces at its output B the waveform as shown in FIG. 5 and this waveform drives, through the resistor 104, a transistor which comprises the synchronizing circuit 48 of FIG. 1. Specifically, the transistor 48 is normally off except when the waveform voltage B approaches zero so that its collector voltage goes high at these times as indicated at C in FIG. 5. These pulses turn the transistor 76 on thereby to dump the capacitor 66 near the zero crossings of the a.c. supply, creating the sawtooth waveform output as shown at D in FIG. 5 when the capacitor 66 is charged through either one or both of the resistors 68 and 70. The Schmitt trigger circuit 100 responds according to the ramp rise rate of the sawtooth waveform to provide the negative polarity pulses of variable time durations $\Delta t$ as shown at E in FIG. 5. These pulses drive the transistor 106 through the resistor 108 to turn it on during these times thereby to energize the light emitting diode 109 through the resistor 110. The time durations of these pulses is dependent upon the Schmitt trigger thresholds 1 and 2 as shown at D in FIG. 5, the maximum voltage at 3 attained by the capacitor 66 being determined by the rate at which it is charged and thus controlling the ramp rise and the time at which the threshold 1 is reached.

The light activated silicon controlled rectifier 112 controls the diode bridge 114, providing a path from the points 116 and 118 thereof, to produce at the output F the waveform as shown in FIG. 5 on the control electrode 88 of the TRIAC 42 thereby controlling the duty cycle to the lamp or load 18 as illustrated at G in FIG. 5.

The component comprising the elements 109 and 112 provides about 1500 volts isolation between the circuit and the supply, thereby providing protection for the user as will be evident hereinafter.

The d.c. supply for the low voltage components is through the diode bridge 102, the diode 120 to the capacitor 122, providing approximately 6 volts for this supply.

The counter 80 comprises the component containing the binaries 123 and 125 in which the output states at 128 and 130 are connected respectively to the diodes 132 and 134 to the respective resistors 68 and 70.

The manner in which the counter 80 is incremented will now be described. The transistors 119 and 121 are connected to form a high impedance amplifier such that contact by the human body or any conductive body of sufficient surface area to the touch pad 32 will serve as an antenna thus providing coupling between the electric field of surrounding power wiring and the high input impedance field effect transistor 119. The gate 94 provides Schmitt trigger action at its input such that if the collector of the transistor 121 swings more than 4 volts from the supply voltage, the gate output will switch to a standard level. The Schmidtt trigger action also provides constant rise and fall time at the line frequency rate of the surrounding power wiring and this action combined with the attack and decay time constant provided by the capacitor 124 and the resistors 129 and 131 and the diode 130 give rejection against noise and transient impulses, power line surges, lightning discharges, etc. and provide for stable finger operation by limiting the maximum stepping rate of the switch.

A neon bulb 133 is placed across the input of the amplifier 119,121 to limit the maximum voltage which can appear across the voltage divider formed by the resistors 135 and 137, thereby limiting voltage applied to the input of the transistor 119 to a safe level. The effect of the resistor 135 is also to reduce the frequency bandwidth of the amplifier so that radio frequency signals cannot activate the switch. Further, the limited bandwidth gives limited rise time to static electrical discharge from the finger and these are thereby typically reduced to about 2 volts at the gate of the transistor 120.

When the capacitor 124 is discharged through the diode 131 and the resistor 129, the Schmidtt trigger action of the gate 98 produces the proper voltage slew rate adequate to clock the counter 80.

The Schmitt trigger action of the gate 96 is utilized to reset the counter 80 when the circuit is powered up, thereby always insuring that when the device is first plugged in, the counter 80 will be set to its original state wherein the lamp circuit is off. The action takes place by virtue of the charging of the capacitor 140 through the resistor 138 when the device is powered up.

We claim:

1. A circuit for controlling the duty cycle applied to a load from an a.c. source, comprising in combination:

variable ramp rate sawtooth generator means for producing a sawtooth waveform whose ramp slope may be varied;

synchronizing means connected to said generator means for causing said sawtooth waveform to be synchronized with the a.c. source;

trigger means connected to said sawtooth waveform generator means for producing a train of output pulses whose time durations are dependent upon the ramp slope of the sawtooth waveform;

switch means connected to said output pulses for controlling the duty cycle of the load in accord with said time durations of the output pulses; and control means connected to said generator means for selectively controlling said ramp slope, said control means comprising a counter having different output states connected to said generator means, and manually actuated means for incrementing said counter.

2. A circuit as defined in claim 1 wherein said switch means is a triac and said synchronizer means causes said output pulses to terminate at the zero crossings of the a.c. source.

3. A circuit for controlling the duty cycle applied to a load from an a.c. source, comprising in combination:

switch means adapted to control connection of the load to the a.c. source;

trigger means having an output connected to the switch means, which output actuates said switch means; and circuit means connected to said trigger means to produce a pulse train output from the trigger means which is synchronized with the a.c. source and in which the time duration of the pulses are selectively variable, said circuit means including a capacitor connected to the input of said trigger means, charging rate means for selectively providing at least two different constant current charging rate outputs whose values are fixed, means for selectively applying one of said two different constant current charging rates to said capacitor, and means for dumping said capacitor in synchronism with the a.c. source.

4. A circuit as defined in claim 3 wherein said charging rate means comprises a counter having at least two outputs, a first resistor connecting one output of the counter to the capacitor, a second resistor connecting the other output of the counter to the capacitor, and control means for incrementing the counter.

5. A circuit as defined in claim 4 wherein said switch means is a triac and said output pulses are synchronized to turn off the triac at every zero crossing of the a.c. source.

6. A circuit as defined in claim 3 wherein said switch means is a triac and said output pulses are synchronized to turn off the triac at every zero crossing of the a.c. source.

7. A lamp assembly comprising, in combination:

a lamp base and a lamp bulb carried by said base;

electrical conductor means and a triac adapted to connect said lamp bulb to an a.c. source; and control means for actuating said triac in synchronism with the a.c. source and for selectively varying the duty cycle of the lamp bulb, said control means including a counter having different output states for varying the duty cycle of the lamp, and manually actuated means on said lamp base for incrementing said counter means.

8. A lamp assembly as defined in claim 7 wherein said control means also includes a capacitor, means for charging said capacitor at different rates according to the output of said counter, and switch means for periodically dumping said capacitor in synchronism with the a.c. source.

9. In a lamp circuit which includes an a.c. source, an incandescent bulb, a normally open electrically controlled switch in series with said source, and control means for operating said switch variably to control the duty cycle thereof whereby to control the intensity of light produced by said bulb, the improvement wherein said control means comprises:

trigger means connected to said electrically controlled switch for producing a train of output pulses in response to a sawtooth signal input, said output pulses closing said switch for the time duration of each such output pulse and said trigger means having fixed threshold points whereby the time duration of each said output pulse is variable in accord with the rate of rise of the sawtooth input to the trigger means;

sawtooth generator means connected to said trigger means for generating said sawtooth signal input to said trigger means, said sawtooth generator means including at least two input terminals for receiving selected different voltage inputs whereby to change the rate of rise of said sawtooth pulses;

phase control means interconnected between said a.c. source and said sawtooth generator means for synchronizing each sawtooth pulse with a corresponding half cycle of said a.c. source;

counter means connected to said input terminals of the sawtooth generator means for providing said selected different voltage inputs to such terminals; and manually actuated means connected to said counter means for incrementing said counter means to select said voltage inputs.

* * * * *